US007809289B2

(12) United States Patent
Dan

(10) Patent No.: US 7,809,289 B2
(45) Date of Patent: Oct. 5, 2010

(54) IMAGE FORMING DEVICE

(75) Inventor: Kenichi Dan, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 181 days.

(21) Appl. No.: 12/213,807

(22) Filed: Jun. 25, 2008

(65) Prior Publication Data

US 2009/0003847 A1 Jan. 1, 2009

(30) Foreign Application Priority Data

Jun. 29, 2007 (JP) ..... 2007-172526

(51) Int. Cl.
*G03G 15/00* (2006.01)

(52) U.S. Cl. ..... 399/13

(58) Field of Classification Search ..... 399/9, 399/12, 13, 16, 23

See application file for complete search history.

(56) References Cited

U.S. PATENT DOCUMENTS

| | | | | |
|---|---|---|---|---|
| 6,959,155 | B2 * | 10/2005 | Kim | 399/21 |
| 7,242,874 | B2 | 7/2007 | Tsusaka | |
| 2005/0220461 | A1 * | 10/2005 | Tsusaka | 399/13 |
| 2006/0034623 | A1 * | 2/2006 | Inukai | 399/9 |
| 2006/0289280 | A1 | 12/2006 | Furuya et al. | |
| 2007/0104497 | A1 * | 5/2007 | Kwon | 399/16 |

FOREIGN PATENT DOCUMENTS

| | | |
|---|---|---|
| JP | 2000-305380 | 11/2000 |
| JP | 2002-328571 | 11/2002 |
| JP | 2005-292357 | 10/2005 |
| JP | 2005-345939 A | 12/2005 |
| JP | 2006-343629 | 12/2006 |

OTHER PUBLICATIONS

JP Office Action dtd May 12, 2009, JP Appln. 2007-172526.

* cited by examiner

*Primary Examiner*—David P Porta
*Assistant Examiner*—Kiho Kim
(74) *Attorney, Agent, or Firm*—Banner & Witcoff, Ltd.

(57) ABSTRACT

An image forming device includes a device body, an image forming unit provided in the device body to form an image on a recording medium, a carrying unit detachably attached to the device body so as to carry a recording medium on a carrying route, a first detecting unit provided on the carrying route to output a detection signal that varies depending on whether there is a recording medium being carried, the first detecting unit including a movable portion that influences the detection signal depending on a location thereof, a displacing unit that changes the location of the movable portion depending on whether the carrying unit is attached to the device body, and a determining unit that determines based upon the detection signal of the first detecting unit whether there is a recording medium being carried and whether the carrying unit is attached to the device body.

20 Claims, 7 Drawing Sheets

IMAGE FORMING DEVICE

CROSS-REFERENCE TO RELATED APPLICATION

Figure 1:
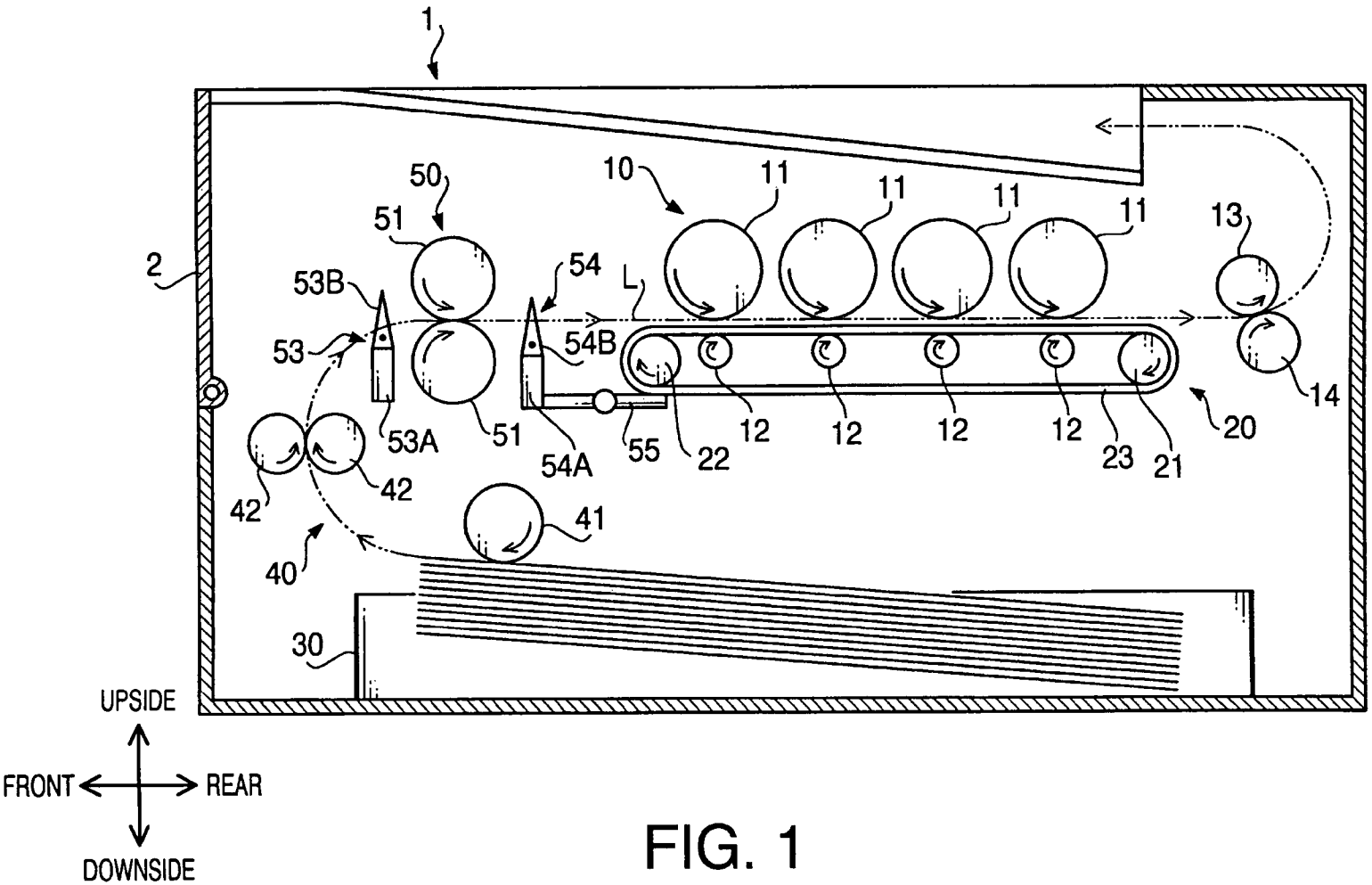

This application claims priority under 35 U.S.C. §119 from Japanese Patent Application No. 2007-172526 filed on Jun. 29, 2007. The entire subject matter of the application is incorporated herein by reference.

BACKGROUND

1. Technical Field

The following description relates to one or more image forming devices with a carrying unit such as a belt unit for carrying a recording medium such as a paper is detachably attached thereto.

2. Related Art

In order to make it easy to maintain a carrying belt for carrying a paper, for example, as disclosed in Japanese Patent Provisional Publication No. 2002-328571 (hereinafter referred to as '571 Publication), there has been proposed such a configuration that a belt unit with a carrying belt incorporated thereinto is detachably attached to a device main body.

However, when the belt unit is detached from the device main body by a user for the maintenance of the carrying belt, the maintenance might be completed despite the belt unit being not attached back to the device main body as a result of user's fault.

To solve the above problem, in the invention disclosed in '571 Publication, the presence of the belt unit can be checked with a reflective optical sensor configured to detect the density of an image transferred to the carrying belt.

SUMMARY

However, the carrying belt deteriorates with a surface thereof getting soiled and worn through usage thereof over time. Therefore, the detection method using the reflective optical sensor is more and more likely to provide an improper detection result with age.

Aspects of the present invention are advantageous in that one or more improved image forming devices are provided that make it possible to detect whether a carrying unit is attached or not with a detecting unit used for another purpose without being influenced by time deterioration of the carrying unit.

According to aspects of the present invention, an image forming device includes a device body, an image forming unit provided in the device body to form an image on a recording medium, a carrying unit detachably attached to the device body so as to carry a recording medium on a carrying route, a first detecting unit provided on the carrying route to output a detection signal that varies depending on whether there is a recording medium being carried on the carrying route, the first detecting unit including a movable portion configured to influence the detection signal depending on a location thereof, a displacing unit configured to change the location of the movable portion depending on whether the carrying unit is attached to the device body, and a determining unit configured to determine based upon the detection signal outputted by the first detecting unit whether there is a recording medium being carried on the carrying route and whether the carrying unit is attached to the device body.

In some aspects of the present invention, it is possible to detect whether the carrying unit is attached to the device body with the existing first detecting unit for detecting whether there is a recording medium being carried on the carrying route. Further, the detection signal of the first detecting unit is influenced by the location of the movable portion that is changed depending on whether the carrying unit is attached to the device body. Therefore, it is possible to detect whether the carrying unit is attached to the device body without being influenced by time deterioration of the carrying unit.

According to another aspect of the present invention, an image forming device includes a device body, an image forming unit provided in the device body to perform an image forming operation of forming an image on a recording medium, a carrying unit detachably attached to the device body so as to carry a recording medium on a carrying route, a first detecting unit and a second detecting unit each of which is provided on the carrying route to output a detection signal that varies depending on whether there is a recording medium being carried on the carrying route and includes a photo-interrupter configured to emit and receive sensing light, and a sensor actuator configured to be moved with respect to the photo-interrupter by contact with a recording medium being carried so as to block the sensing light of the photo-interrupter, a displacing unit configured to displace the photo-interrupter of the first detecting unit into such a position that the sensor actuator never blocks the sensing light of the photo-interrupter when the carrying unit is detached from the device body, and a determining unit configured to determine, based upon the detection signals outputted by the first detecting unit and the second detecting unit, whether there is a recording medium being carried on the carrying route and whether the carrying unit is attached to the device body.

With the image forming device configured as above, the same effects as the previously-described image forming device can be provided. Further, since the aforementioned configuration includes the second detecting unit as well as the first detecting unit, it is possible to more definitely determine whether there is a recording medium being carried on the carrying route and whether the carrying unit is attached to the device body.

BRIEF DESCRIPTION OF THE ACCOMPANYING DRAWINGS

FIG. 1 schematically shows a mechanical configuration of a printer in a first embodiment according to one or more aspects of the present invention.

Figure 2:
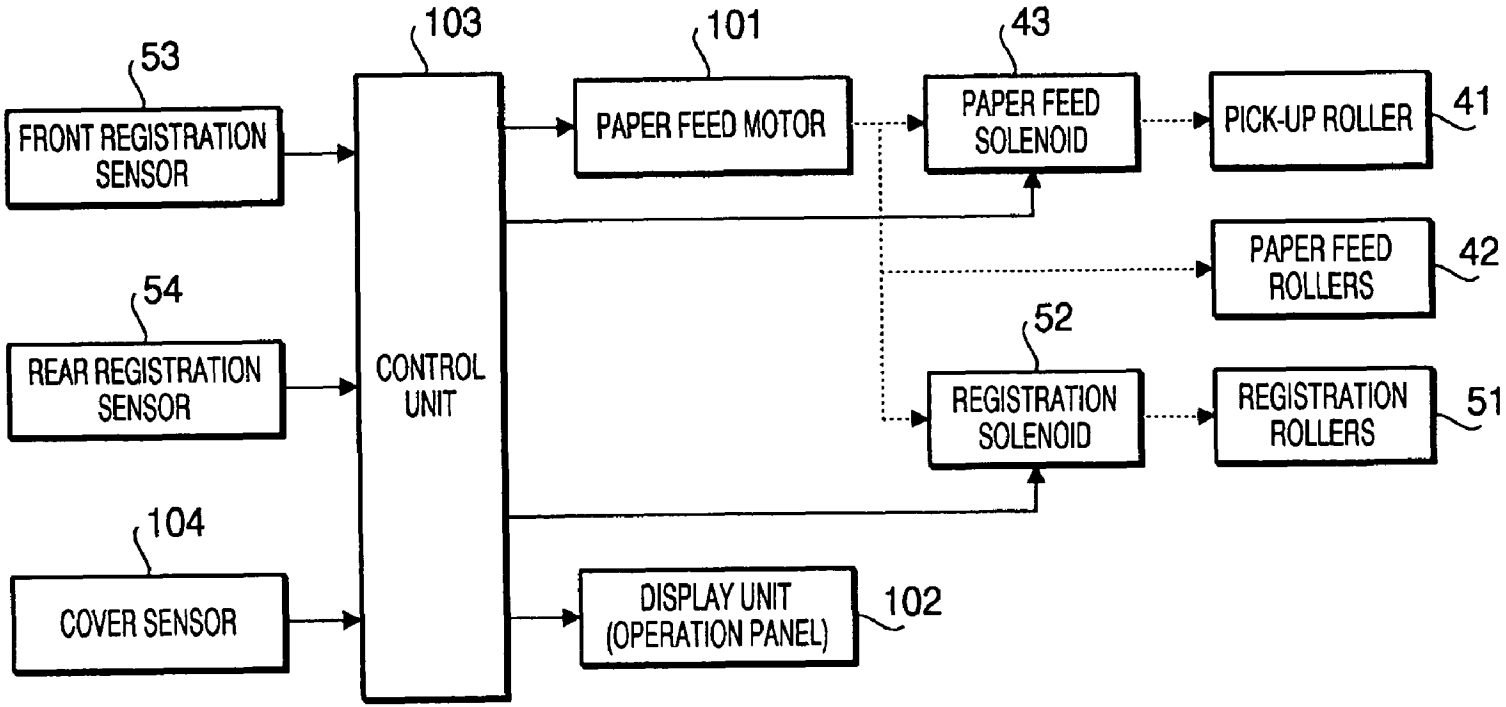

FIG. 2 is a block diagram schematically showing an electrical configuration of the printer in the first embodiment according to one or more aspects of the present invention.

Figure 3A:
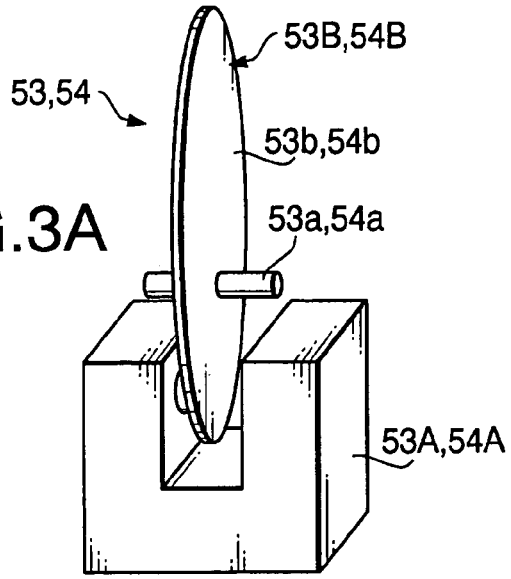
Figure 3B:
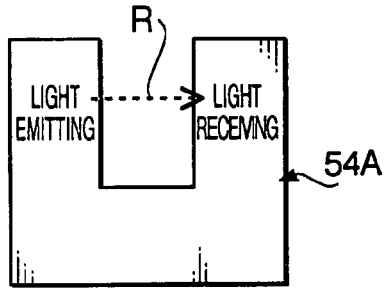
Figure 3C:
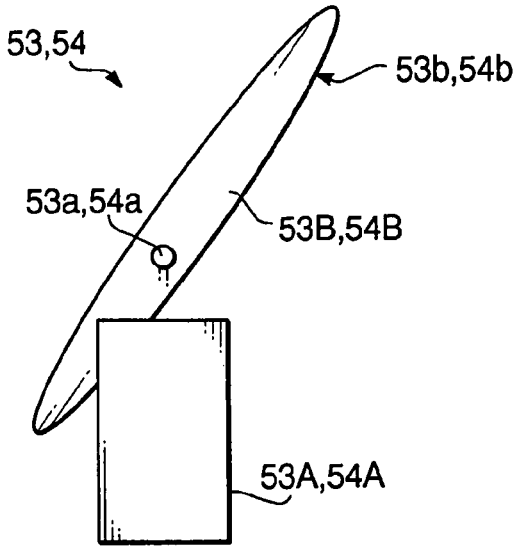

FIGS. 3A, 3B, and 3C are illustrations of a front registration sensor and a rear registration sensor in the first embodiment according to one or more aspects of the present invention.

Figure 4:
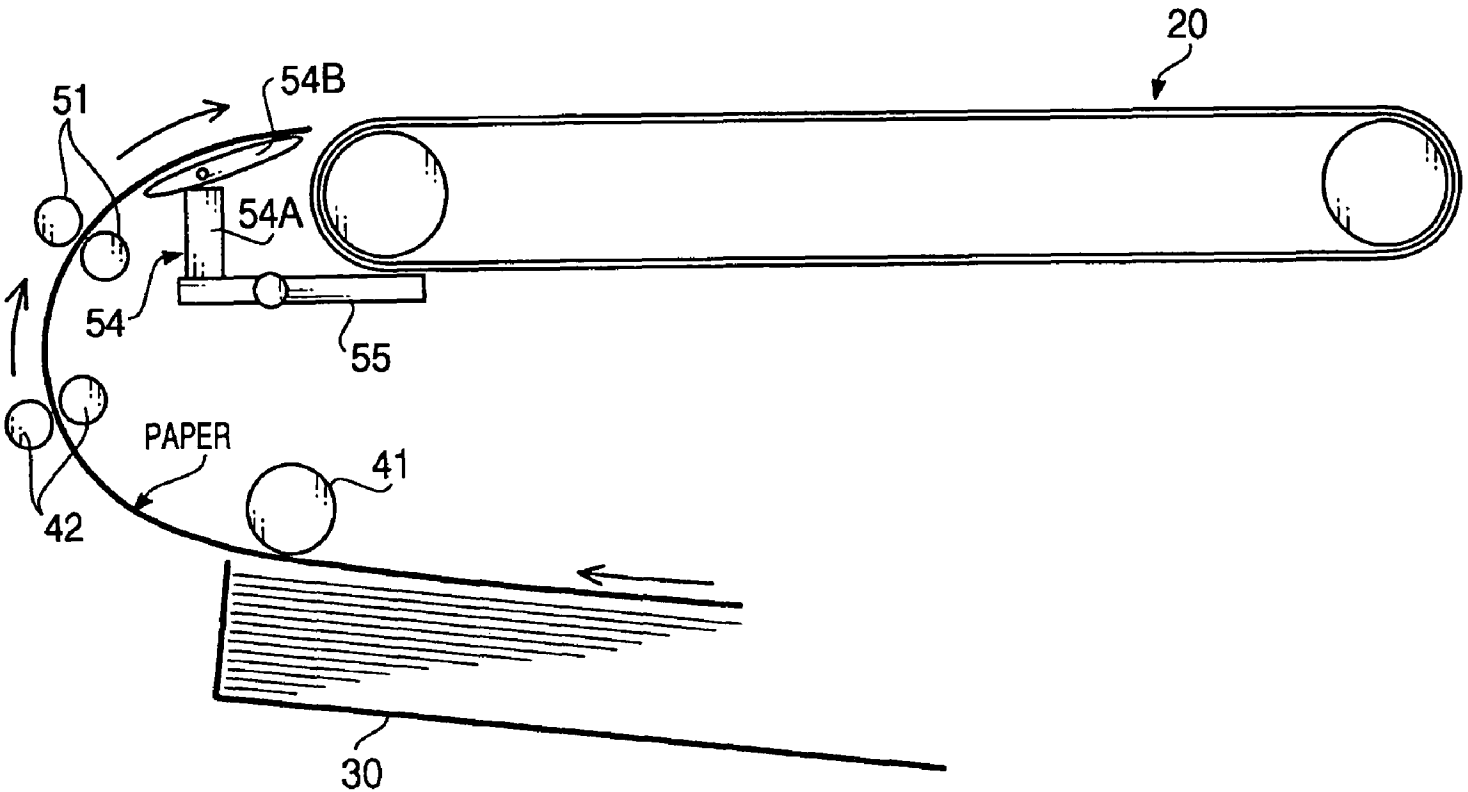

FIG. 4 schematically shows states of a lever and photo-interrupter when a belt unit is attached in the first embodiment according to one or more aspects of the present invention.

Figure 5:
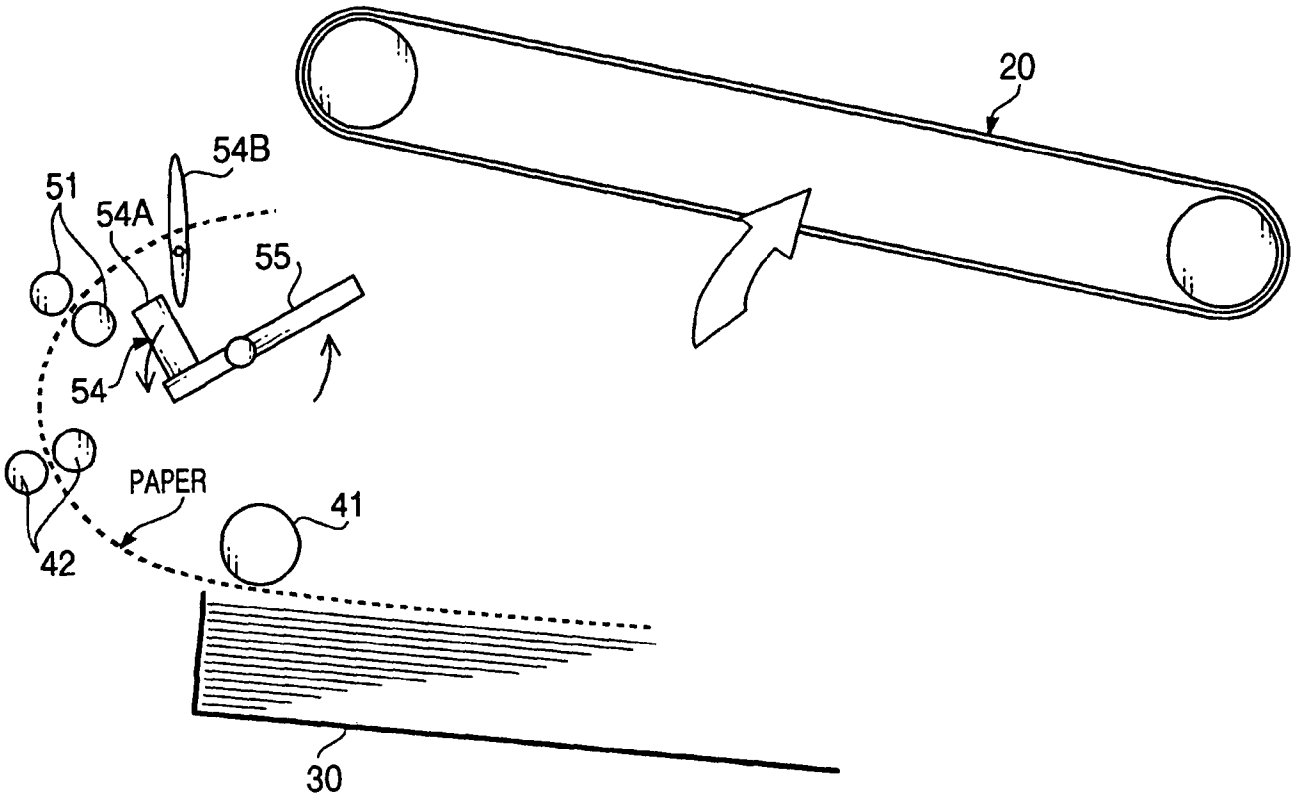

FIG. 5 schematically shows states of the lever and photo-interrupter when the belt unit is detached in the first embodiment according to one or more aspects of the present invention.

Figure 6:
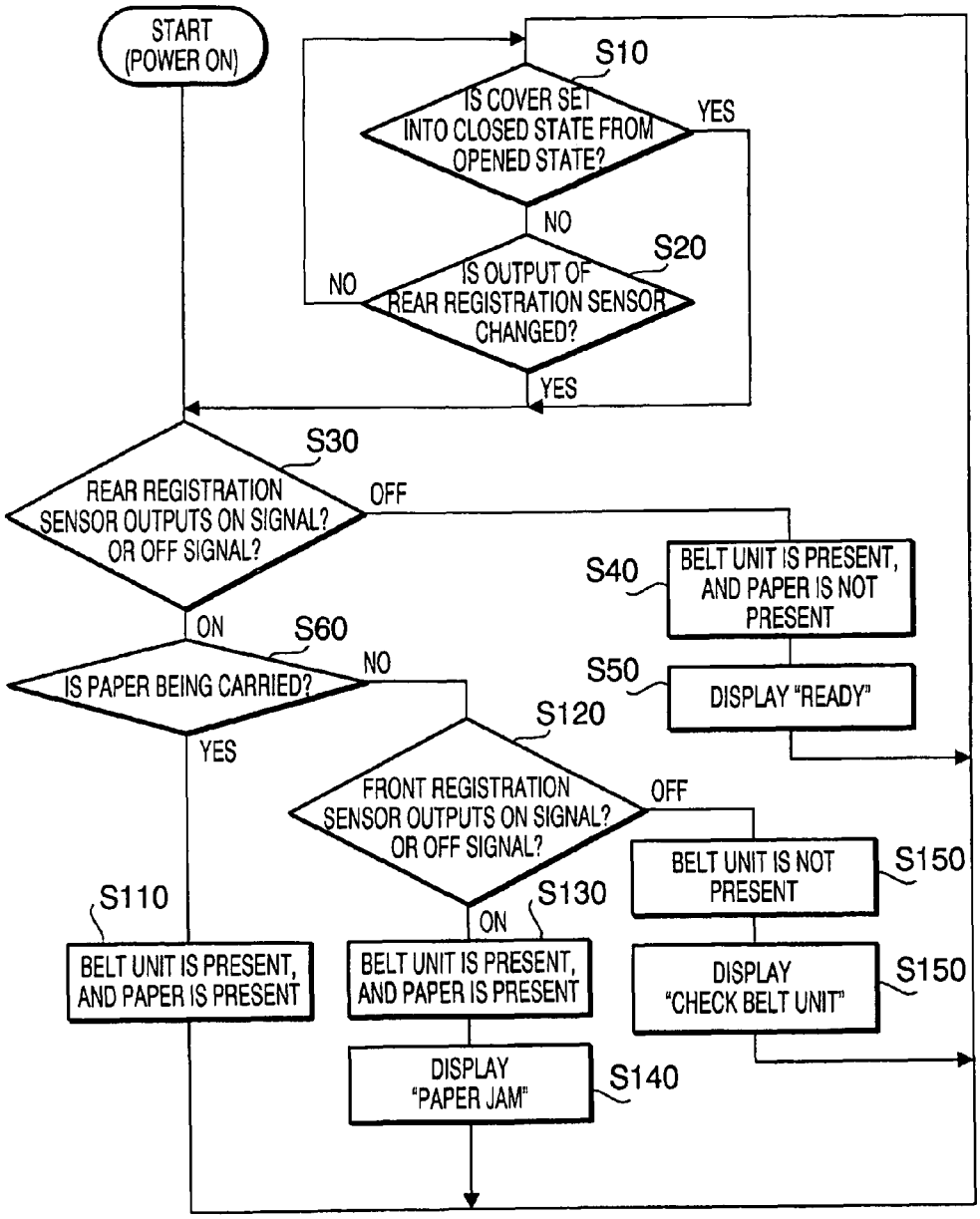

FIG. 6 is a flowchart showing a control process for detecting the belt unit attached in the first embodiment according to one or more aspects of the present invention.

Figure 7A:
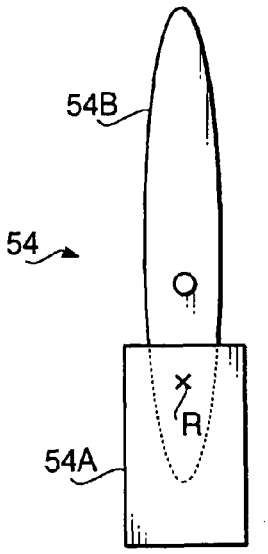
Figure 7B:
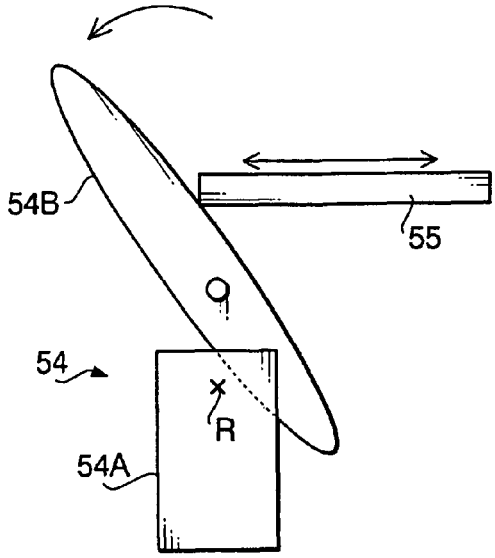

FIGS. 7A and 7B schematically show the rear registration sensor in the case where the belt unit is attached and the case where the belt unit is not attached, respectively, in a second embodiment according to one or more aspects of the present invention.

Figure 8A:
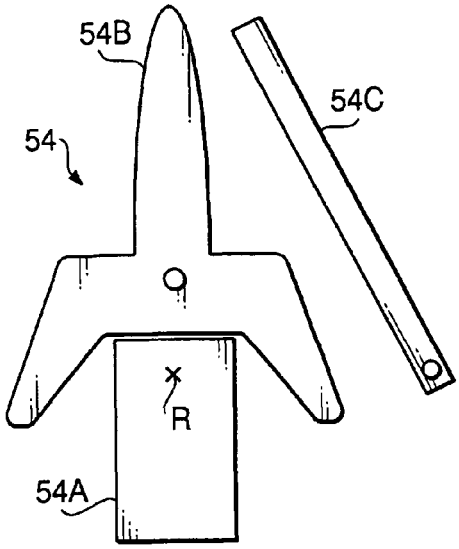
Figure 8B:
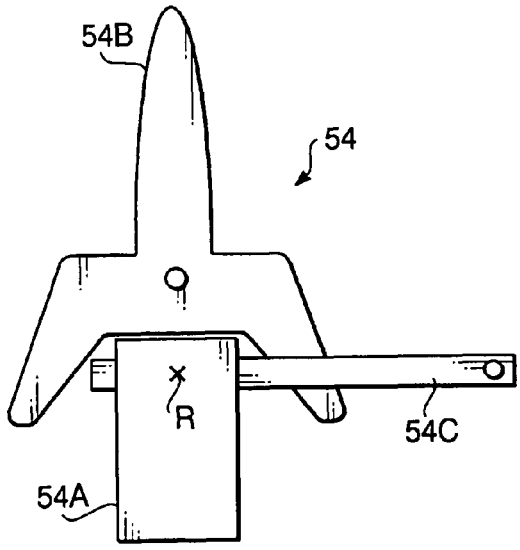

FIGS. 8A and 8B schematically show a rear registration sensor in the case where the belt unit is attached and the case where the belt unit is not attached, respectively, in a third embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Below-mentioned embodiments, in each of which an image forming device according to aspects of the present invention is applied to a color laser printer (hereinafter simply referred to as a printer), will be described with reference to the accompanying drawings.

First Embodiment

1. Schematic Configuration of Printer 1.1. Mechanical Configuration

FIG. 1 schematically shows a mechanical configuration of a printer 1 in a first embodiment according to aspects of the present invention. In FIG. 1, a reversed-S-shaped route indicated by a chain double dashed arrow denotes a carrying route L of a recording medium such as a recording paper (hereinafter referred to as a paper). The arrow of the carrying route L indicates a carrying direction of the paper. On the way of the carrying route L, an electrophotographic image forming unit 10 configured to form an image on the paper is provided.

It is noted that, as shown in FIG. 1, a left side, right side, upside, and downside of FIG. 1 are defined as a front side, rear side, upside, and downside of the printer 1, respectively. Further, in FIG. 1, arrows for constituent elements indicated by reference characters 11 to 14, 21, 22, 41, 42, and 51 denotes respective rotational directions of the constituent elements.

The electrophotographic image forming unit 10 is, as widely known, provided with photoconductive drums 11 each of which is configured to hold an image of developer disposed by a disposure unit (not shown) on a surface thereof, transcriptional rollers 12 configured to transfer onto the paper the developer image held on the photoconductive drums 11, a heating roller 13 configured to heat and fix the developer transferred onto the paper, and pressing roller 14 configured to press the paper against the heating roller 13.

It is noted that the image forming unit 10 in the present embodiment is a direct tandem type image forming means with a plurality of photoconductive drums 11 and transcriptional rollers 12 disposed linearly in the carrying direction of the paper.

Further, the printer 1 includes a belt unit 20 configured to convey the paper transmitted to the image forming unit 10. The belt unit 20 is provided with a driving roller 21 rotated along with an operation of the image forming unit 10, driven roller (tension roller) 22 rotatably disposed in a position separated from the driving roller 21, and endless belt 23 wound over the driving roller 21 and driven roller 22.

The belt unit 20 is detachably attached to a device main body. In addition, a space accommodating the belt unit 20 is closed with an openable and closable cover 2 provided at the front side of the printer 1. Therefore, when implementing maintenance of the belt unit 20, a user opens the cover 2 and detaches the belt unit 20 from the device main body. It is noted that the device main body represents non-movable portions of the printer 1 such as a housing and flame.

The printer 1 further includes a paper feed tray 30 provided at the downside in the printer 1, in which at least one paper to be fed to the image forming unit 10 is placed. On the substantially U-shaped carrying route L joining the paper feed tray 30 and image forming unit 10, a feeding-out unit 40 and sending-out unit 50 are provided, in an order arranged from an upstream side in the carrying direction.

The feeding-out unit 40 is configured to feed out a paper placed in the paper feed tray 30 to the image forming unit 10 side. The feeding-out unit 40 includes a pick-up roller 41, paper feed rollers 42, and a paper feed solenoid 43 (see FIG. 2, which is a block diagram schematically showing an electrical configuration of the printer 1).

The pick-up roller 41 is configured to pick up the paper placed in the paper feed tray 30. The paper feed rollers 42 are configured with a pair of rollers provided at a downstream side of the pick-up roller 41 in the carrying direction so as to convey the paper to the sending-out unit 50.

The paper feed solenoid 43 is configured to establish and break transmission of power to the paper feed rollers 42 and pick-up roller 41. In the present embodiment, when applying current to the paper feed solenoid 43, a driving force of a paper feed motor 101 (see FIG. 2) is transmitted to the pick-up roller 41. Meanwhile, when blocking the current to the paper feed solenoid 43, the transmission of the driving force to the pick-up roller 41 is blocked.

The sending-out unit 50 is configured with a pair of registration rollers 51, and registration solenoid 52 (see FIG. 2). The registration rollers 51 are provided between the feeding-out unit 40 and image forming unit 10 at a downstream side of the image forming unit 10 in the carrying direction so as to perform skew correction for the paper being carried. The registration solenoid 52 is configured to establish and break transmission of power to the registration rollers 51.

In the present embodiment, when applying current to the registration solenoid 52, the transmission of the driving force to the registration rollers 51 is blocked. Meanwhile, when blocking the current to the registration solenoid 52, the driving force is transmitted to the registration rollers 51.

A front registration sensor 53 and rear registration sensor 54 for detecting the presence of the paper are provided in the vicinity of the registration rollers 51, at an upstream side and downstream side of the registration rollers 51 in the carrying direction, respectively. Each of the front registration sensor 53 and rear registration sensor 54 is configured with a transmission optical sensor. Further, the rear registration sensor 54 is disposed in the vicinity of the front registration sensor 53 so as to detect the presence of the paper concurrently with the front registration sensor 53.

Specifically, as shown in FIG. 3A, the front registration sensor 53 and rear registration sensor 54 are configured with respective photo-interrupters 53A and 54A and respective sensor actuators 53B and 54B.

Each of the photo-interrupters 53A and 54A is configured, in an angular U-shape with a light emitting element and light receiving element which are disposed to face each other through a predetermined gap, to output different signals depending on whether light emitted by the light emitting element is received by the light receiving element.

The sensor actuators 53B and 54B include respective shafts 53Ba and 54Ba fixed to part of the main body of the printer 1, and respective light-shielding plates 53Bb and 54Bb which are supported so as to be oscillated around the respective shafts 53Ba and 54Ba. The light-shielding plates 53Bb and 54Bb are oscillated due to contact with the paper conveyed, and shifted with respect to the photo-interrupters 53A and 54A, respectively. Thereby, the state of each sensor 53 or 54 is switched between a state where an optical path R from the light emitting element to the light receiving element is blocked and a state where the optical path R is opened.

The photo-interrupter 53A of the front registration sensor 53 is fixed to the device main body, while the photo-interrupter 54A of the rear registration sensor 54 is incorporated into the device main body so as to be oscillated with respect to the device main body when the belt unit 20 is detached.

Specifically, as shown in FIG. 1, the photo-interrupter 54A is attached to a first end of a lever 55 in a longitudinal direction of the lever 55 which is rotatably attached to the device main body. On the other hand, the second end of the lever 55 in the longitudinal direction thereof is pressed by the belt unit 20.

It is noted that the second end of the lever 55 in the longitudinal direction thereof is pressed by a portion that does not disturb the carrying operation of the belt unit 20 (e.g., a member that firmly supports the belt unit 20 with respect to the device main body).

Therefore, when the belt unit 20 is detached from the device main body, a force pressing the second end of the lever 55 is cleared, and thereby the photo-interrupter 54A is, as shown in FIG. 5, oscillated due to a force of gravity so as to be away from the sensor actuator 54B.

Accordingly, when the belt unit 20 is attached to the device main body, and a paper does not contact the sensor actuator 54B (see FIG. 1), the optical path R of the photo-interrupter 54A is blocked. Thus, the rear registration sensor 54 issues an OFF signal (Low signal).

Further, when the belt unit 20 is attached to the device main body, and a paper contacts the sensor actuator 54B (see FIG. 4), the optical path R of the photo-interrupter 54A is opened. Therefore, the rear registration sensor 54 issues an ON signal (High signal).

Further, when the belt unit 20 is not attached to the device main body, and a paper does not contact the sensor actuator 54B (see FIG. 5), the optical path R of the photo-interrupter 54A is opened. Therefore, the rear registration sensor 54 issues the ON signal.

Additionally, when the belt unit 20 is not attached to the device main body, the photo-interrupter 54A is shifted up to a location outside a movable range of the sensor actuator 54B. Therefore, even though a paper contacts the sensor actuator 54B in the case where the belt unit 20 is not attached to the device main body, the optical path R of the photo-interrupter 54A is opened. Thereby, the rear registration sensor 54 outputs the ON signal.

It is noted that the movable range of the sensor actuator 54B represents a predetermined range within which the light-shielding plate 54Bb of the sensor actuator 54B can block the optical path R of the photo-interrupter 54A.

When the rear registration sensor 54B outputs the OFF signal, the belt unit 20 is always attached to the device min body. On the contrary, when the rear registration sensor 54B issues the ON signal, the belt unit 20 may not always be attached to the device main body.

In addition, the photo-interrupter 53A of the front registration sensor 53 is fixed to the device main body. Therefore, when a paper contacts the sensor actuator 53B, the optical path R of the photo-interrupter 53A is opened, and the front registration sensor 53 outputs the ON signal (High signal).

Meanwhile, when a paper does not contact the sensor actuator 53B, the optical path R is blocked. Thus, the front registration sensor 53 issues the OFF signal (Low signal). Namely, the front registration sensor 53 outputs the ON signal or OFF signal depending on the existence/nonexistence of the paper, regardless of the existence/nonexistence of the belt unit 20.

1.2. Electrical Configuration

FIG. 2 is a block diagram schematically showing en electrical configuration of the printer 1. In FIG. 2, a main motor (paper feed motor) 101 is configured to supply a driving force to the pick-up roller 41, paper feed rollers 42, registration rollers 51, photoconductive drums 11, transcriptional rollers 12, and heating roller 13. The paper feed rollers 42, photoconductive drums 11, transcriptional rollers 12, and heating roller 13 are rotated mechanically in synchronization with the rotation of the paper feed motor 101.

A display unit 102 is configured to display thereon various kinds of information. The display unit 102, paper feed motor 101, paper feed solenoid 43, and registration solenoid 52 are operated under control by a control unit 103.

It is noted that the control unit 103 is configured with a widely-known microcomputer that includes a CPU, ROM, and RAM. The control unit 103 controls the paper feed solenoid 43 and registration solenoid 53 in accordance with a program previously stored in a memory such as the ROM, based upon the output signals of the front registration sensor 53 and rear registration sensor 54.

Additionally, the paper feed motor 101, paper feed solenoid 43, and registration solenoid 52 are controlled to be in an OFF state when waiting ready without performing an image forming operation.

2. Control for Detecting Attached Belt Unit See FIG. 6

FIG. 6 is a flowchart showing a control process for detecting the belt unit 20 attached. The control process is booted when the printer 1 is powered ON.

When the printer 1 is powered ON, firstly, it is determined whether the rear registration sensor 54 issues the ON signal (S30). When it is determined that the rear registration sensor 54 issues the OFF signal (S30: OFF), the belt unit 20 is attached, and it is determined that a paper is not left in a position where the rear registration sensor 54 is disposed (S40). Then, a display (e.g., "Ready") representing that the printer 1 is in a state capable of performing a printing operation is shown on the display unit 102 (S50).

Next, based upon a detection signal of a cover sensor 104 (see FIG. 2), it is determined whether the cover 2 is set into the closed state from the opened state (S10). When it is determined that the cover 2 is set into the closed state from the opened state (S10: Yes), the present process goes back to S30.

When it is determined that the cover 2 is not set into the closed state from the opened state (S10: No), it is determined whether the output of the rear registration sensor 54 is changed into the other state (namely, ON to OFF, or OFF to ON) (S20). When it is determined that the output of the rear registration sensor 54 is changed into the different state (S20: No), the step of S10 is executed again.

Meanwhile, when it is determined whether the output of the rear registration sensor 54 is changed into the different state (S20: Yes), it is determined again whether the rear registration sensor 54 outputs the ON signal (S30). When it is determined that the rear registration sensor 54 outputs the ON signal (S30: ON), it is determined whether a paper is being conveyed, namely, whether the main motor 101 is rotated and the paper feed solenoid 43 is set ON (S60).

When it is determined that a paper is being conveyed (S60: Yes), it is determined that the belt unit 20 is attached and a paper placed in the paper feed tray 30 is normally fed out (S110), and the present process goes to S10.

When it is determined whether a paper is not being conveyed (S60: No), it is determined whether the front registration sensor 53 outputs the ON signal (S120). When it is determined that the front registration sensor 53 outputs the ON signal (S120: ON), it is determined that the belt unit 20 is attached, yet paper jam is caused (S130). Then, a warning for notifying that paper jam is caused (e.g., "Paper Jam") is displayed on the display unit 102 (S140), and thereafter the step S10 is executed again.

Meanwhile, when it is determined that the front registration sensor 53 outputs the OFF signal (S120: OFF), it is determined that the belt unit 20 is not attached (S150). Then, a warning for inducing the user to check the vicinity of the belt unit 20 (e.g., "Check Belt Unit") is displayed on the display unit 102 (S160), and thereafter the step S10 is executed again.

Additionally, when it is determined that the front registration sensor 53 outputs the OFF signal (S120: OFF), the belt unit 20 is likely not to be attached, yet there may be considered to no small extent, a possibility that paper jam is caused in a state where a paper contacts the rear registration sensor 54.

Therefore, there is displayed on the display unit 102, not a warning for notifying that the belt unit 20 is not attached but the warning for inducing the user to check the vicinity of the belt unit 20.

3. Features of Printer in Embodiment

In the present embodiment, when the belt unit 20 is attached to the device main body, and a paper is not present on the carrying route L, the photo-interrupter 54A is located in the position where the rear registration sensor 54 outputs the OFF signal. Meanwhile, when the belt unit 20 is not attached to the device main body, the photo-interrupter 54A is shifted into the position where the rear registration sensor 54 outputs the ON signal. Therefore, it is possible to detect the belt unit 20 attached with the existing rear registration sensor 54 for detecting whether a paper is present or not.

Namely, in the present embodiment, when the rear registration sensor 54 outputs the ON signal in the image forming operation by the image forming unit 10 (namely, in the case where a paper feeding operation is started), it is determined that a paper is present and the belt unit 20 is attached to the device main body (S110). Meanwhile, when the rear registration sensor 54 issues the OFF signal, it is determined that a paper is not present in the state where the belt unit 20 is attached to the device main body. Thus, it is possible to certainly check the belt unit 20 attached by using the existing rear registration sensor 54.

Additionally, the rear registration sensor 54 detects the belt unit 20 attached, based upon the signal corresponding to the state of the photo-interrupter 54A that moves depending on whether the belt unit 20 is attached or not. Hence, it is possible to detect the belt unit 20 attached without being significantly affected by time deterioration of the belt unit 20.

Accordingly, in the present embodiment, using a detecting means, which is employed for another purpose in the printer 1, to detect whether the belt unit 20 is attached, the belt unit 20 attached can be checked without being significantly affected by the time deterioration of the belt unit 20.

In the meantime, the rear registration sensor 54 can output two kinds of signals, the ON signal and OFF signal, yet issues the ON signal in any of the state where the belt unit 20 is not attached and the state where the presence of the paper is detected when the belt unit 20 is attached. Therefore, when the rear registration sensor 54 outputs the ON signal, it is impossible to determine which state is a current state.

In this respect, in the present embodiment, based upon the combination of the output signals of the rear registration sensor 54 and front registration sensor 53, it is determined whether a paper is present on the carrying route L (S60), and whether the belt unit 20 is attached to the device main body (S110). Therefore, it is possible to determine which state of the aforementioned states is a current state.

Further, in the present embodiment, when the printer 1 is powered ON, it is determined in the step S10 that the cover 2 is set into the closed state from the opened state (S10: Yes), or it is determined in the step S20 that the output signal of the rear registration sensor 54 is changed into the other state (S20: Yes), it is determined whether the belt unit 20 is attached to the device main body. Then, when it is not determined that the belt unit 20 is attached to the device main body, a warning is issued (S160). Thus, the user can easily recognize that the belt unit is not attached.

Further, in the present embodiment, since the photo-interrupter 54A is configured to be movable, it is possible to easily achieve such a configuration that the rear registration sensor 54 outputs the OFF signal when the belt unit 20 is not attached to the device main body.

Second Embodiment

FIGS. 7A and 7B schematically show the rear registration sensor 54 in the case where the belt unit 20 is attached and the case where the belt unit 20 is not attached, respectively, in a second embodiment according to aspects of the present embodiment. In the second embodiment, as shown in FIGS. 7A and 7B, a lever 55 is configured such that, when the belt unit 20 is detached from the device main body, the sensor actuator 54B is tilted to the upstream side in the carrying direction of the paper, and the optical path R of the photo-interrupter 54A is always opened regardless of existence/nonexistence of the paper. It is noted that, in the present embodiment, the photo-interrupter 54A is fixed to the device main body.

With the aforementioned configuration, in the present embodiment as well, when the belt unit 20 is attached to the device main body, and a paper is not present on the carrying route L, the rear registration sensor 54 outputs the OFF signal. Meanwhile, when the belt unit 20 is not attached, the rear registration sensor 54 issues the ON signal. Thus, the belt unit 20 attached can be detected in the same control process as the first embodiment.

Third Embodiment

FIGS. 8A and 8B schematically show a rear registration sensor 54 in the case where the belt unit 20 is attached and the case where the belt unit 20 is not attached, respectively, in a third embodiment according to aspects of the present embodiment. In the third embodiment, as shown in FIGS. 8A and 8B, a movable portion 54C separate from a sensor actuator 54B is provided. By rendering the movable portion 54C move in conjunction with an attachment state of the belt unit 20 via a movable member such as the lever 55, the state of the photo-interrupter 54 fixed to the device main body is switched between a state where the optical path R of the photo-interrupter 54 is blocked and a state where the optical path R is opened.

In the present embodiment, as shown in FIGS. 8A and 8B, the lever 55 is configured such that the movable portion 54C blocks the optical path R of the photo-interrupter 54A when the belt unit 20 is detached from the device main body, regardless of the existence/non-existence of the paper.

Further, as shown in FIGS. 8A and 8B, a lower portion of the sensor actuator 54B is formed in a bifurcated shape. When a paper contacts the sensor actuator 54B, the sensor actuator 54B is moved such that one of the bifurcated portions blocks the optical path R.

In the present embodiment, when the belt unit 20 is attached to the device main body, and a paper is not present on the carrying route L, the rear registration sensor 54 outputs the ON signal. Meanwhile, when the belt unit 20 is not attached, the rear registration sensor 54 issues the OFF signal. Therefore, in the present embodiment, the ON/OFF state of the output signal issued by the rear registration sensor 54 depending on the aforementioned cases is different from that in the first embodiment, yet operations and steps in the control process other than the respect are the same as the first embodiment.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Modifications

In the aforementioned embodiments, the ON/OFF state of the rear registration sensor 54 is changed by the lever depending on the attachment state of the belt unit 20. However, the present invention is not limited to such configurations. For example, the ON/OFF state of the front registration sensor 53 may be changed by the lever 55 depending on the attachment state of the belt unit 20. Further, any other sensors may be applied instead of the rear registration sensor 54 or the front registration sensor 53.

What is claimed is:

1. An image forming device, comprising:

a device body;

an image forming unit provided in the device body to form an image on a recording medium;

a carrying unit detachably attached to the device body so as to carry a recording medium on a carrying route;

a first detecting unit provided on the carrying route to output a detection signal that varies depending on whether there is a recording medium being carried on the carrying route, the first detecting unit including a movable portion configured to influence the detection signal depending on a location thereof;

a displacing unit configured to change the location of the movable portion depending on whether the carrying unit is attached to the device body; and a determining unit configured to determine based upon the detection signal outputted by the first detecting unit whether there is a recording medium being carried on the carrying route and whether the carrying unit is attached to the device body, wherein the first detecting unit is configured to output a first signal when there is a recording medium being carried on the carrying route, wherein the first detecting unit is configured to output a second signal when there is not a recording medium being carried on the carrying route, wherein the displacing unit locates the movable portion in a first position where the first detecting unit is configured to output the second signal when the carrying unit is attached to the device body, wherein the displacing unit locates the movable portion in a second position where the first detecting unit cannot output the second signal when the carrying unit is detached from the device body, and wherein, when the first detecting unit outputs the second signal, the determining unit determines that there is not a recording medium being carried on the carrying route, and that the carrying unit is attached to the device body.

2. The image forming device according to claim 1, wherein, when the carrying unit is attached to the device body, the first detecting unit outputs the first signal in case where there is a recording medium being carried on the carrying route and outputs the second signal in case where there is not a recording medium being carried on the carrying route, and wherein the first detecting unit outputs the first signal when the carrying unit is detached from the device body.

3. The image forming device according to claim 1, wherein, when the first detecting unit outputs the first signal in an image forming operation by the image forming unit, the determining unit determines that the carrying unit is attached to the device body, and that there is a recording medium being carried on the carrying route, and wherein, when the first detecting unit outputs the second signal in the image forming operation, the determining unit determines that the carrying unit is attached to the device body, and that there is not a recording medium being carried on the carrying route.

4. The image forming device according to claim 1, further comprising a second detecting unit provided on the carrying route so as to output the first signal in case where there is a recording medium being carried on the carrying route, and to output the second signal in case where there is not a recording medium being carried on the carrying route, wherein the determining unit determines, based upon combination of signals outputted by the first detecting unit and the second detecting unit, whether there is a recording medium being carried on the carrying route, and whether the carrying unit is attached to the device body.

5. The image forming device according to claim 4, wherein the determining unit determines that there is not a recording medium being carried on the carrying route, and the carrying unit is detached from the device body, when the first detecting unit outputs the first signal, and the second detecting unit outputs the second signal.

6. The image forming device according to claim 4, wherein the second detecting unit is disposed in a vicinity of the first detecting unit so as to detect whether there is a recording medium being carried on the carrying route concurrently with the first detecting unit.

7. The image forming device according to claim 1, further comprising a second detecting unit provided on the carrying route so as to output a detection signal that varies depending on whether there is a recording medium being carried on the carrying route, wherein the determining unit determines based upon the detection signals outputted by the first detecting unit and the second detecting unit whether there is a recording medium being carried on the carrying route, and whether the carrying unit is attached to the device body.

8. The image forming device according to claim 7, wherein the second detecting unit is disposed in a vicinity of the first detecting unit such that the first detecting unit and the second detecting unit concurrently detect whether there is a recording medium being carried on the carrying route.

9. The image forming device according to claim 1, further comprising:

a cover configured to be opened and closed when the carrying unit is attached to and detached from the device body; and a warning unit configured to issue a warning when the determining unit determines that the carrying unit is detached from the device body, in one of a case where the image forming device is powered on and a case where the cover is closed after the image forming device is powered on.

10. The image forming device according to claim 1, wherein the carrying unit includes a belt unit, wherein the image forming device further comprises a pair of registration rollers provided at a downstream side of the carrying unit in a direction in which a paper is carried so as to perform skew correction for a recording medium being carried, and wherein the first detecting unit is disposed between the carrying unit and the registration rollers.

11. The image forming device according to claim 1, wherein the first detecting unit includes a first member and a second member configured to be moved with respect to the first member in response to contact with a recording medium being carried.

12. The image forming device according to claim 11, wherein the first member of the first detecting unit includes the movable portion whose location is changed by the displacing unit.

13. The image forming device according to claim 12, wherein the first detecting unit includes an optical sensor, wherein the optical sensor comprises:

a photo-interrupter configured to emit and receive sensing light; and a sensor actuator configured to be moved with respect to the photo-interrupter by the contact with a recording medium being carried so as to block the sensing light of the photo-interrupter, and wherein, when the carrying unit is detached from the device body, the displacing unit displaces the photo-interrupter into such a position that the sensor actuator never blocks the sensing light of the photo-interrupter.

14. The image forming device according to claim 11, wherein the second member of the first detecting unit includes the movable portion whose location is changed by the displacing unit.

15. The image forming device according to claim 11, wherein the movable portion is provided separately from the first member and the second member.

16. An image forming device, comprising:

a device body;

an image forming unit provided in the device body to perform an image forming operation of forming an image on a recording medium;

a carrying unit detachably attached to the device body so as to carry a recording medium on a carrying route;

a first detecting unit and a second detecting unit each of which is provided on the carrying route to output a detection signal that varies depending on whether there is a recording medium being carried on the carrying route and includes a photo-interrupter configured to emit and receive sensing light, and a sensor actuator configured to be moved with respect to the photo-interrupter by contact with a recording medium being carried so as to block the sensing light of the photo-interrupter;

a displacing unit configured to displace the photo-interrupter of the first detecting unit into such a position that the sensor actuator never blocks the sensing light of the photo-interrupter when the carrying unit is detached from the device body; and a determining unit configured to determine, based upon the detection signals outputted by the first detecting unit and the second detecting unit, whether there is a recording medium being carried on the carrying route and whether the carrying unit is attached to the device body, wherein the first detecting unit is configured to output a first signal when there is a recording medium being carried on the carrying route, wherein the first detecting unit is configured to output a second signal when there is not a recording medium being carried on the carrying route, wherein the displacing unit locates the photo-interrupter in a first position where the first detecting unit is configured to output the second signal when the carrying unit is attached to the device body, wherein the displacing unit locates the photo-interrupter in a second position where the first detecting unit cannot output the second signal when the carrying unit is detached from the device body, and wherein, when the first detecting unit outputs the second signal, the determining unit determines that there is not a recording medium being carried on the carrying route, and that the carrying unit is attached to the device body.

17. An image forming device, comprising:

a device body;

an image forming unit provided in the device body to form an image on a recording medium;

a carrying unit detachably attached to the device body so as to carry a recording medium on a carrying route;

a first detecting unit provided on the carrying route to output a detection signal that varies depending on whether there is a recording medium being carried on the carrying route, the first detecting unit including a movable portion configured to influence the detection signal depending on a location thereof;

a displacing unit configured to change the location of the movable portion depending on whether the carrying unit is attached to the device body; and a determining unit configured to determine based upon the detection signal outputted by the first detecting unit whether there is a recording medium being carried on the carrying route and whether the carrying unit is attached to the device body, wherein the carrying unit includes a belt unit, wherein the image forming device further comprises a pair of registration rollers provided at a downstream side of the carrying unit in a direction in which a paper is carried so as to perform skew correction for a recording medium being carried, and wherein the first detecting unit is disposed between the carrying unit and the registration rollers.

18. An image forming device, comprising:

a device body;

an image forming unit provided in the device body to form an image on a recording medium;

a carrying unit detachably attached to the device body so as to carry a recording medium on a carrying route;

a first detecting unit provided on the carrying route to output a detection signal that varies depending on whether there is a recording medium being carried on the carrying route, the first detecting unit including a movable portion configured to influence the detection signal depending on a location thereof;

a displacing unit configured to change the location of the movable portion depending on whether the carrying unit is attached to the device body; and a determining unit configured to determine based upon the detection signal outputted by the first detecting unit whether there is a recording medium being carried on the carrying route and whether the carrying unit is attached to the device body, wherein the first detecting unit includes a first member and a second member configured to be moved with respect to the first member in response to contact with a recording medium being carried.

19. An image forming device, comprising:

a device body;

an image forming unit provided in the device body to perform an image forming operation of forming an image on a recording medium;

a carrying unit detachably attached to the device body so as to carry a recording medium on a carrying route;

a first detecting unit and a second detecting unit each of which is provided on the carrying route to output a detection signal that varies depending on whether there is a recording medium being carried on the carrying route and includes a photo-interrupter configured to emit and receive sensing light, and a sensor actuator configured to be moved with respect to the photo-interrupter by contact with a recording medium being carried so as to block the sensing light of the photo-interrupter;

a displacing unit configured to displace the photo-interrupter of the first detecting unit into such a position that the sensor actuator never blocks the sensing light of the photo-interrupter when the carrying unit is detached from the device body; and a determining unit configured to determine, based upon the detection signals outputted by the first detecting unit and the second detecting unit, whether there is a recording medium being carried on the carrying route and whether the carrying unit is attached to the device body, wherein the carrying unit includes a belt unit, wherein the image forming device further comprises a pair of registration rollers provided at a downstream side of the carrying unit in a direction in which a paper is carried so as to perform skew correction for a recording medium being carried, and wherein the first detecting unit is disposed between the carrying unit and the registration rollers.

20. An image forming device, comprising:

a device body;

an image forming unit provided in the device body to perform an image forming operation of forming an image on a recording medium;

a carrying unit detachably attached to the device body so as to carry a recording medium on a carrying route;

a first detecting unit and a second detecting unit each of which is provided on the carrying route to output a detection signal that varies depending on whether there is a recording medium being carried on the carrying route and includes a photo-interrupter configured to emit and receive sensing light, and a sensor actuator configured to be moved with respect to the photo-interrupter by contact with a recording medium being carried so as to block the sensing light of the photo-interrupter;

a displacing unit configured to displace the photo-interrupter of the first detecting unit into such a position that the sensor actuator never blocks the sensing light of the photo-interrupter when the carrying unit is detached from the device body; and a determining unit configured to determine, based upon the detection signals outputted by the first detecting unit and the second detecting unit, whether there is a recording medium being carried on the carrying route and whether the carrying unit is attached to the device body, wherein the first detecting unit includes a first member and a second member configured to be moved with respect to the first member in response to contact with a recording medium being carried.

* * * * *